US006091826A

United States Patent [19]

Laitinen et al.

[11] Patent Number: 6,091,826

[45] Date of Patent: Jul. 18, 2000

[54] METHOD FOR IMPLEMENTING A SOUND REPRODUCTION SYSTEM FOR A LARGE SPACE, AND A SOUND REPRODUCTION SYSTEM

[75] Inventors: Arvo Olavi Laitinen, Nurmijärvi; Jarkko Tapio Vuori, Espoo, both of Finland

[73] Assignee: Farm Film Oy, Klaukkala, Finland

[21] Appl. No.: 08/913,476

[22] PCT Filed: Mar. 15, 1996

[86] PCT No.: PCT/FI96/00156

§ 371 Date: Sep. 15, 1997

§ 102(e) Date: Sep. 15, 1997

[87] PCT Pub. No.: WO96/29779

PCT Pub. Date: Sep. 26, 1996

[30] Foreign Application Priority Data

Mar. 17, 1995 [FI] Finland ..... 951272

[51] Int. Cl.[7] ..... H04R 27/00

[52] U.S. Cl. ..... 381/82; 381/56; 381/77; 381/80

[58] Field of Search ..... 381/56, 57, 58, 381/59, 77, 79, 80, 81, 82, 85, 96, 121, 124

[56] References Cited

U.S. PATENT DOCUMENTS

| | | | |
|---|---|---|---|
| 4,219,696 | 8/1980 | Kogure et al. . | |
| 4,618,987 | 10/1986 | Steinke et al. . | |
| 5,131,051 | 7/1992 | Kishinaga et al. | 381/77 |
| 5,233,661 | 8/1993 | Kawamura et al. | 381/77 |
| 5,239,543 | 8/1993 | Janssens | 381/80 |
| 5,406,634 | 4/1995 | Anderson et al. | 381/82 |
| 5,444,783 | 8/1995 | Na | 381/57 |
| 5,487,067 | 1/1996 | Matsushige | 381/80 |
| 5,576,685 | 11/1996 | Saito | 381/82 |
| 5,724,430 | 3/1998 | Aarts et al. | 381/59 |

FOREIGN PATENT DOCUMENTS

| | | | |
|---|---|---|---|
| 2687002 | 8/1993 | France | 381/59 |
| 6-121393 | 4/1994 | Japan | 381/82 |
| 2123193 | 1/1984 | United Kingdom . | |
| 2211685 | 7/1989 | United Kingdom . | |
| 2221595 | 2/1990 | United Kingdom . | |
| WO 8801453 A1 | 2/1988 | WIPO . | |

*Primary Examiner*—Forester W. Isen
*Assistant Examiner*—Xu Mei
*Attorney, Agent, or Firm*—Nixon & Vanderhye

[57] ABSTRACT

The invention relates to a method for implementing a sound reproduction system for a large space, and a sound reproduction system. In accordance with the invention, a) loudspeaker units (LU) are placed in different parts of said space, and the information to be transmitted by the loudspeaker unit to its environment is fed to said loudspeaker unit from an information source (CPU) common to several loudspeaker units, b) determinations specific to said loudspeaker unit are carried out in a separate loudspeaker unit (LU), and c) a message is sent from the loudspeaker unit (LU) to the common information source (CPU), said message (20) containing information obtained on the basis of said determination. For accomplishing a system that is able to transmit individual information effectively to the different parts of the system, a reply message is transmitted in response to said message from the common information source (CPU) to the loudspeaker unit that has carried out the transmission, said reply message containing such information intended to be transmitted by the loudspeaker unit in which the message depends on the information received by the common information source.

19 Claims, 2 Drawing Sheets

METHOD FOR IMPLEMENTING A SOUND REPRODUCTION SYSTEM FOR A LARGE SPACE, AND A SOUND REPRODUCTION SYSTEM

BACKGROUND OF THE INVENTION

The present invention relates to systems widely used in large spaces, such as shops or work rooms, for providing audio information and/or visual information to people moving in the rooms in question. In particular, the invention relates to a sound reproduction system comprising a plurality of separate loudspeaker units via which information is transmitted, as well as to a method for implementing a system of this kind.

The sound reproduction system in accordance with the invention is thus intended for use in large spaces, particularly in shopping centres or large shops where there is a need to transmit current, situation-specific or individual information to customers or other people moving in the room in question. A large space refers herein to the space in which the sound reproduction system is situated. This space is typically larger than a normal room (or e.g. a studio), usually a public space which may be either a roofed or an open space.

As to the terms "sound-reproduction system" and "loudspeaker unit" used in this description, it must be stated that they are used since in almost all the embodiments of the system, at least audio information is transmitted. It must be understood, however, that said terms also cover such an embodiment in which a "loudspeaker unit" only comprises a display unit for transmitting textual information (this relates to solutions in accordance with the attached claims 1 and 12).

The aim of a sound reproduction system used in a large space, such as a shopping centre, is to create a sound background suitable for the function of the space in question. Sound reproduction is usually carried out by means of several loudspeakers, to which common audio information (typically background music) is supplied from a common sound source via fixed wiring. Acoustics management in a large space of this kind is often problematic, however, since the circumstances may differ from each other a great deal in different parts of the space. Acoustics management is further complicated by the fact that some of these differences are constant in proportion to time, and others, in turn, vary in proportion to time.

Sound pressure levels used in spaces of this kind are usually low, and the listening is usually such that the sounds are heard in the background. The sound pressure level varies in sequences e.g. depending on the number of visitors. The clarity of the audio message depends on the ratio of the background noise and the useful sound, and only a sufficient excess over the background noise enables understanding the message. On the other hand, too strong a sound background is often perceived as disturbing.

As mentioned above, this kind of a sound reproduction system of a large room or another space is typically implemented by means of a plurality of loudspeakers which are connected to the sound source via a fixed wiring. Prior art methods and systems of this kind do not, however, enable effective management of a rapidly varying acoustic environment of a large room in order that the audio message be as clear as possible in different and varying conditions.

Another important drawback of these prior art methods is their inability to concentrate different types of acoustic information into a smaller part of the whole space simultaneously, that is, instructive information or shop advertising for certain (different) groups of customers moving in different parts of the space covered by the system.

In typical prior art solutions, cabling costs are high, and possibilities of making flexible changes are weak. In addition, it is difficult to implement mobile sound reproduction systems.

Prior art sound reproduction systems for large spaces do not enable a flexible sound reproduction system either. In a flexible sound reproduction system measurements are carried out in a room (small space), and on the basis of these measurements the operation of the sound reproduction system is adjusted.

In some of the prior art systems more flexibility has been aimed at by combining each loudspeaker unit (having a unique address) to the data and audio bus of the system, whereby the desired loudspeaker units can be turned off via a common central processing unit and a desired audio message can be sent only via specific loudspeakers. This type of sound reproduction system, or a public address system is disclosed in British Patent No. 2,123,193. In the loudspeaker unit of this system it is also possible to test whether an individual loudspeaker is operating, and to send the information on the test to the central processing unit. Although some more flexibility has been gained by means of the system, the major drawbacks described above still exist, particularly the inability to send information specific to the state of an individual loudspeaker unit to each loudspeaker unit.

SUMMARY OF THE INVENTION

The object of the present invention is thus to achieve an improvement to the drawbacks disclosed above by providing a new type of sound reproduction or information system by means of which the features of the space covered by the system can be supported effectively and individual information can be transmitted to various parts of the space covered by the system. This is achieved with solutions in accordance with the invention, the method being characterized in what is claimed in the characterizing parts of the attached claims 1 and 9, and in the characterizing part of the attached claim 12.

The idea of the invention is to form a network consisting of several loudspeaker units possessing signal processing capacity, the network also comprising a server common to the loudspeaker units, and to provide the individual loudspeaker units with monitoring means, by means of which they are able to monitor their environment (people moving in the space, their own location and/or sound field), and thus inform the server of the changes taking place in the environment. The server controls each loudspeaker unit individually on the basis of the information it has received, either by changing the message contained in the information transmitted by the loudspeaker unit or the features of the audio information transmitted by the loudspeaker unit, or both. (These features include e.g. sound pressure, frequency response, etc.)

The major advantages of the system are the possibility of providing individually concentrated information, such as instructions or advertisements at the right moment to the chosen parts of the space covered by the system, and an improved audibility, as well as the quality of the audio information in the various parts of the large space. Other advantages of the system are versatile programming and operating functions, as well as a more advantageous structure especially in rapidly varying conditions.

Continuous adjustment of the sound pressure level in accordance with the background sound, or noise allows distinguishing of the useful signal better than heretofore, which enables lower volume levels than before. This makes the stay in the space covered by the system more comfortable.

By means of the measurements allowed by the system, e.g measurements of the sound pressure level, the operation of the system, and particularly the content of the information conveyed by it can be controlled. It is thus possible to transmit e.g. advertisements to the desired parts of the shop when the sound-level meter detects that the sound pressure level has risen, or when some other monitoring device of the loudspeaker unit detects a customer in its vicinity. In other situations, e.g. normal background music can be transmitted to the target area.

The system of the invention also enables monitoring people's movements in the space covered by the system, whereby the system can change its operations when necessary according to where people move and where they stop to monitor their environment.

In accordance with a preferred embodiment of the invention, separate loudspeaker units are arranged to be mobile, and they are equipped with positioning means which communicate the information on the location of the loudspeaker unit to the central processing unit of the system.

In accordance with another preferred embodiment of the invention, the information to be stored in the common server is transferred by radio via a broadcasting network. It is thus possible to maintain the audio and information material used by even more than one sound reproduction system, and to control the system when necessary.

BRIEF DESCRIPTION OF THE DRAWINGS

In the following, the invention and its preferred embodiments will be described in greater detail with reference to the examples in accordance with the attached drawings in which.

DETAILED DESCRIPTION OF THE PREFERRED EMBODIMENTS

Figure 1:
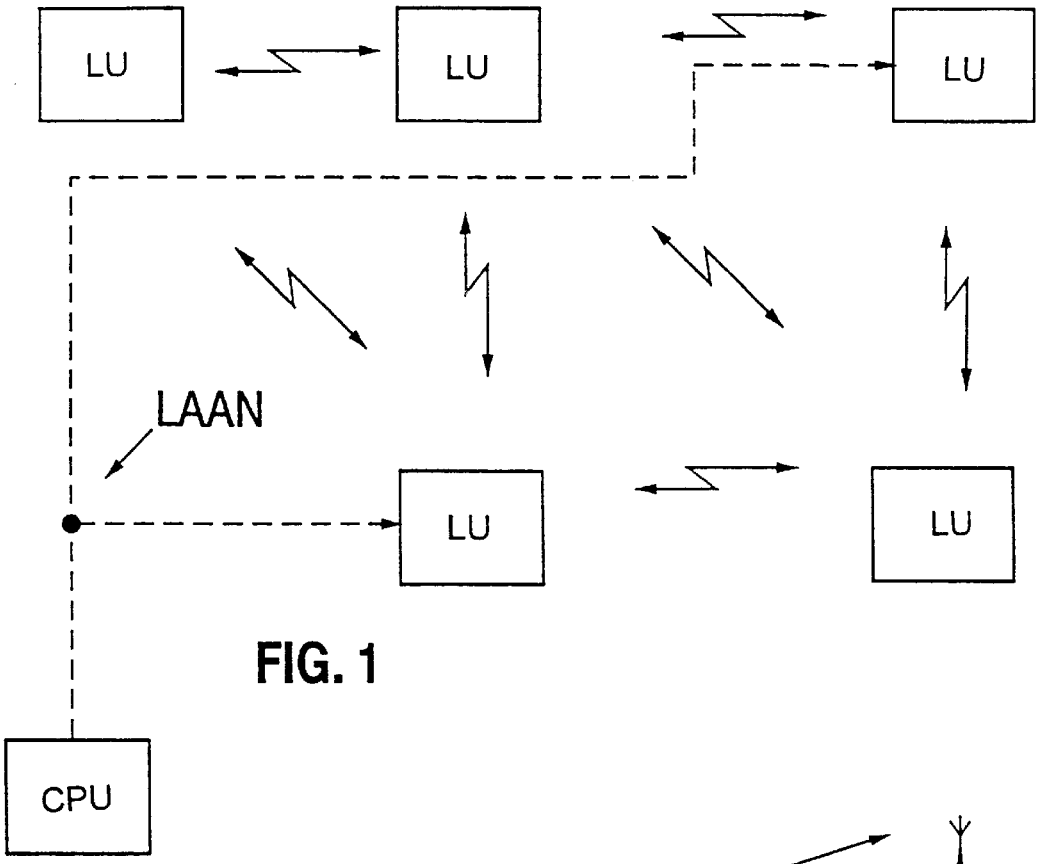
FIG. 1 shows a schematic picture of the loudspeaker system of the present invention.

FIG. 1 shows a schematic illustration of the sound reproduction system of the invention. The system comprises a central processing unit CPU, which provides the sound source of the system, as well as a plurality of separate loudspeaker units LU which are connected to the central processing unit by means of a fixed and/or a wireless network, whereby the central processing unit and the loudspeaker units form a kind of a local area network (which is marked with a reference sign LAAN, Local Area Audio Network), in which the central processing unit functions as the server transmitting e.g. audio information specific to each loudspeaker unit in response to the information it has received from the loudspeaker units. The information transmitted in the network is thus advantageously in the digital form, and the loudspeaker unit converts digital audio information first into analog form, and thereafter into acoustic form. In the example shown in FIG. 1, the central processing unit CPU is connected to some loudspeaker units by wires (broken lines) and the loudspeaker units communicate with each other wirelessly (arrows). Wireless communication can be implemented e.g. by making use of infra-red light or a radio signal (in the same way as prior art wireless local area networks connected with computers).

The most advantageous way (wireless and/or fixed) of connecting the central processing unit and the loudspeaker units to each other in each case depends on several factors, such as the demands made on the sound reproduction system, the extent of the system (the number of the loudspeaker units), and the operating environment. Technically the simplest way is to connect the different unit to each other by means of wires. In small and static sound reproduction systems this may even be the most feasible alternative. If mobile loudspeaker units are used in the system, or if the locations of the (fixed) loudspeaker units must often be changed for other reasons, e.g. due to re-arrangement of the sales premises, wireless communication must be employed between different loudspeaker units. The loudspeaker units may thus be moved freely, and there is no need to arrange separate wiring between the different units.

Figure 2:
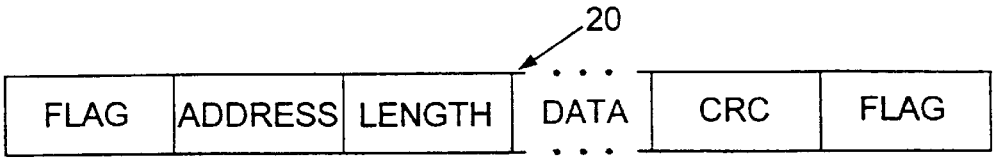
FIG. 2 illustrates the structure of the data packets transmitted in the sound reproduction system of the invention.

Communication between the different units of the system advantageously takes place in a packet transfer mode. In such a case, the central processing unit sends the required information to the loudspeaker unit in one information burst, or data package. Correspondingly, the loudspeaker unit replies to the central processing unit with a data package. FIG. 2 shows an example of a data package. The start of a data package marked with reference sign 20 is detected with a specific bit sequence, flag or synchronizing pattern, which is marked with sign FLAG. All the units receiving data packages listen to the traffic in the network, and upon detecting a flag pattern they start to receive information passing along the line. After the synchronizing pattern, a field ADDRESS containing the information on the address follows in the data package. The ADDRESS field is used for addressing the data package in question to the right loudspeaker unit and further to the right information source (loudspeaker or display) within a loudspeaker unit. In addition to the address of the receiving party, the address field may also contain the address of the transmitting party. Each central processing unit and loudspeaker unit in the system is numbered with an identification number different from one another. Each unit also has an individual internal address space by means of which it is possible to distinguish from each other the information sources contained in the unit. A unit that detects its own address continues listening to the message, and the other units stop listening to the message. After the address information, a field LENGTH indicating the length of the package follows in the data package. The data packages may be different in length depending e.g. on the length of the audio information to be transmitted, so that the information on the length of the package must be transmitted along with the data package. After the length field, a data field containing the actual information to be transmitted follows in the data package, said field being marked with sign DATA in the figure. This information may be either coded audio information, textual information intended for the display unit or different measurement and control data (in which case there may also be a short code field inside the DATA field indicating the type of the information). After the data field, there is an error correction field CRC for confirming the correctness of the information. Error correction may be based on the generally known Cyclic Redundancy Check principle. The data package to be transmitted is ended with a flag pattern (FLAG) similar to the one used for starting it. A similar package can be used both in a fixed and a wireless network. Wireless data transfer can also be implemented in analog form.

Figure 3:
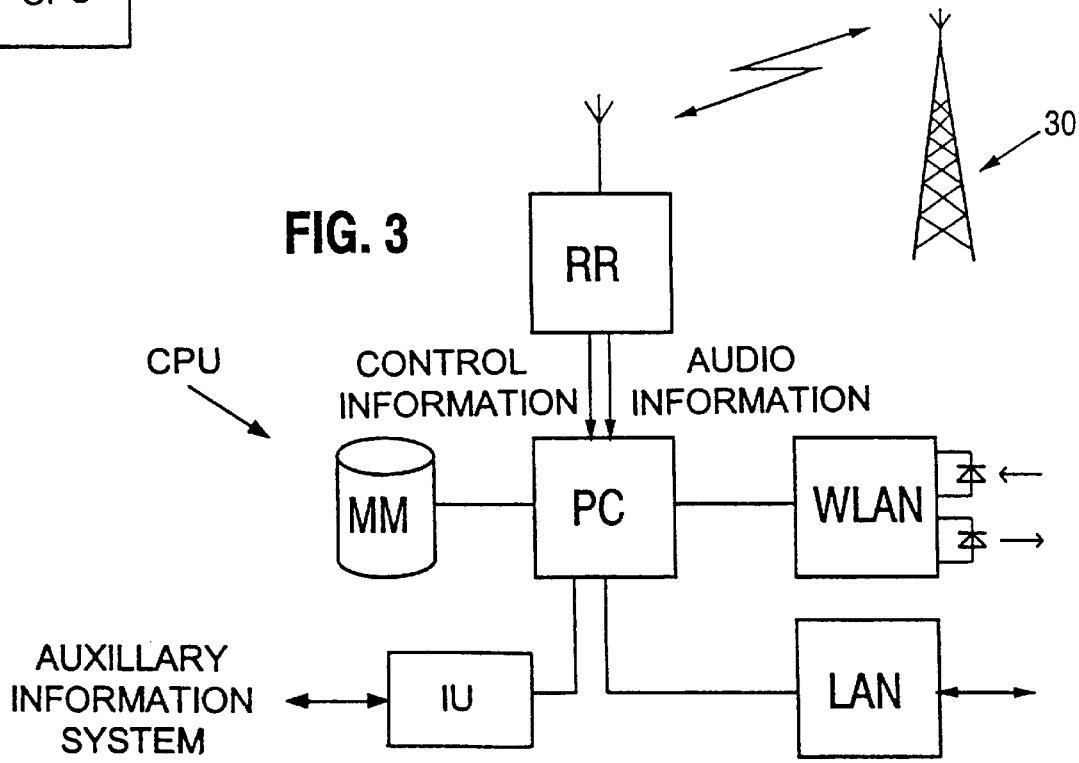
FIG. 3 is a block diagram illustrating the structure of the central processing unit of sound reproduction system of the invention.

FIG. 3 illustrates the structure of the central processing unit CPU used in the sound reproduction system of the invention. The central processing unit comprises a control unit PC, which may be e.g. a conventional personal computer having a software tailored for this purpose; a mass memory unit MM (e.g. a hard disk) connected to the control unit, for storing the sound or textual information used by the system; and either a wireless local area network interface unit WLAN or a fixed local area network interface unit LAN, or both. In addition, the central processing unit may comprise:

- a radio receiver RR, which is connected to the control unit PC, or
- an interface unit IU, by means of which the central processing unit may be connected to the rest of the information system, e.g. to the teller terminal system of a shop. The interface may be e.g. serial (e.g. RS-232) or a local area network interface of the Ethernet type.

The role of the radio receiver and the interface unit will be described in greater detail below.

The central processing unit CPU receives from the loudspeaker unit LU, via the fixed or the wireless network (and the corresponding interface unit WLAN or LAN), measurement or other monitoring data on the conditions related to each loudspeaker unit. On the basis of this data the central processing unit selects the information to be sent to the loudspeaker unit via the network. A more detailed description of the selection process will follow below. Besides audio information or textual information intended for the display unit, the central processing unit may also transmit (individual) control information to each loudspeaker unit.

The radio receiver possibly located in the central processing unit CPU may be a receiver unit e.g. in accordance with a known RDS system (Radio Data System) for receiving control messages transmitted via the broadcasting network. This receiver unit may also control the operation of the central processing unit (as will be described below). The major task of the radio receiver, however, is to function as a device by means of which the information stored in the mass memory unit can be updated or by means of which information can be relayed in real-time to the loudspeaker unit.

The control unit stores the audio information used by the system to the mass memory unit in the digitized form. A standard hard disk drive, for instance, may function as the mass memory unit, and it may practically have a storage capacity in the order of 1 GB, for instance. It is advantageous to store audio information in a format coded in an appropriate manner, e.g. by means of MPEG coding, which is a standard used in the field. The storage capacity thus increases in proportion to compression.

The mass memory unit contains audio information stored in form of logical sound sequences, which can be retrieved from the mass memory unit MM when necessary, and sent to the loudspeaker unit in the data field of the data package shown in FIG. 2. Each logical sound sequence advantageously forms one record, and the control unit PC can retrieve the sound sequences from the mass memory unit by referring to the name of the sound sequence (the name of the record), which may be e.g. the number of the sound sequence. A logical sound sequence refers to the fact that the message contained in it forms one logical whole. The records to be stored can also be formed so that certain generally used words or parts of sentences (or music excerpts) are only stored once, and the central processing unit combines a larger number of such records one after another so that they form one logical message. Logical sound sequences may be combined e.g. so that there is a speech sequence on a music background. In fixed networks, in particular, it is advantageous to expand the data prior to sending a data package, since expansion must thus be carried out in the central processing unit only. On the other hand, expansion can also be carried out in the loudspeaker units LU, which results in savings in the switching capacity of the network. This may be necessary in wireless networks.

Figure 4:
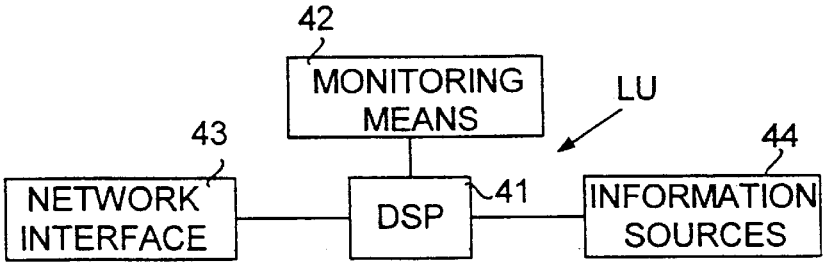
FIG. 4 shows the principle of the structure of an individual loudspeaker unit used in the sound reproduction system of the invention.

FIG. 4 shows the principle of the structure of the loudspeaker unit LU used in the sound reproduction system of the invention. The core of the loudspeaker unit is constituted by a signal processor unit 41 which is formed e.g. around a conventional signal processor. The signal processor unit is connected with a monitoring device unit 42 (which may include e.g. a radar or a sound pressure level detector) for monitoring the conditions related to the loudspeaker unit, and an information source unit 44 (which typically comprises at least a loudspeaker) for presenting the information to people in the vicinity of the loudspeaker unit. In addition, the loudspeaker unit comprises a network interface unit 43 for connecting the signal processor unit to a fixed and/or wireless network.

The loudspeaker unit can e.g. measure the current sound pressure level in the loudspeaker zone by means of the detector and adjust the sound pressure level of the loudspeaker on the basis of the measurements. The sound pressure level can also be transmitted in form of measurement data to the central processing unit (sound source) CPU for centralized control (of sound pressure level). The loudspeaker unit may also independently adjust the equalization and compression of the sound in accordance with the sound pressure level. It is possible to measure the sound pressure level when the loudspeaker is transmitting audio information, or to turn down the loudspeaker for the duration of the measurement, in which case it is possible to obtain information on whether there are people in the vicinity of the loudspeaker unit (e.g. customers).

By means of the radar (which may operate e.g. on the Doppler principle) the loudspeaker unit monitors people moving in its environment. The radar provides information e.g. on a person stopping at the measurement point (such as a customer stopping at the sales counter). This piece of information can be transmitted to the central processing unit, which controls the sound to be transmitted to the loudspeaker unit in response to the information it has received (it selects e.g. the records containing the offers valid at the sales counter in question).

The sound pressure level detector provides a cost-efficient solution, but it only allows detecting the presence of people. A loudspeaker unit provided with a radar is costlier, but it also provides the information on the moment at which a person stops in the vicinity of the loudspeaker unit, whereby it is possible to concentrate the audio message as well as possible.

Figure 5:
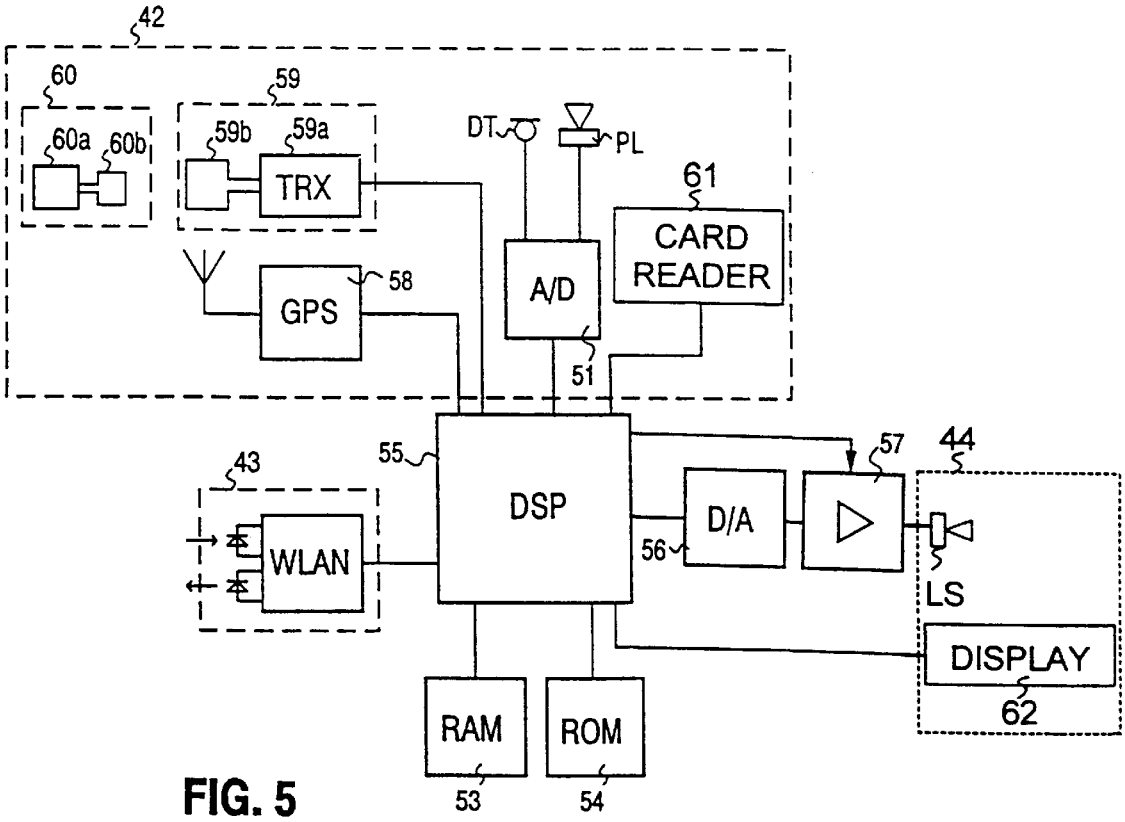
FIG. 5 is a more detailed block diagram of the structure of an individual loudspeaker unit.

FIG. 5 shows a more detailed illustration of different variations of the loudspeaker unit LU of the invention, and the different functions of the system. The figure shows the information sources and monitoring devices with which an individual loudspeaker unit can be provided. As will be described below, part of these devices are alternative between each other, so that a typical loudspeaker unit of the system does not include all the devices shown in the figure.

If a fixed network connection is employed in the system, it can be based on signalling in accordance with the standard RS-485, for example. Circuit implementations that comply with this norm are manufactured e.g. by Linear Technology Corp., U.S.A. If the network interface (marked with WLAN) is a wireless connection based on the radio path, or, as shown in FIG. 5, a connection based on data transfer carried out by means of an infra-red electromagnetic wave, there are suitable circuits available for this purpose, as well; the manufacturer may be e.g. Crystal Semiconductor, U.S.A.

As stated above, the core of the loudspeaker unit is constituted by a conventional digital signal processor 55, which carries out the calculation to be made in the loudspeaker unit. The signal processor is provided with necessary interface circuits in order that it could communicate with the devices monitoring the environment of the loudspeaker unit on the one hand, and with the telecommunications network (the central processing unit or other loudspeaker units) on the other. The signal processor unit is further connected to a program memory 54 (e.g. a ROM memory) in which the software used by the processor is stored, and a data memory 53 (RAM or DRAM) in which the data used by the processor is stored. Signal processor units suited for the purpose are manufactured e.g. by Motorola Corp., U.S.A. or Texas Instruments, U.S.A.

The signal processor unit enables effective implementation of digital signal processing algorithms. Since the signal processor unit can be controlled by means of software, its flexibility in changing situations is rather high. The information transmitted by the loudspeaker unit can thus be shaped flexibly by means allowed by digital signal processing. It is thus possible to implement in the loudspeaker unit e.g. filters having variable parameters, turning down the desired parts of the transmitted audio information. A shaping device of this type based on digital signal processing is the equalizer, whose one implementation is disclosed in the DSD application instructions APR2/D of Motorola Corp.

The task of the loudspeaker LS of the loudspeaker unit is to convert an electrical signal into an audible acoustic sound. The loudspeaker is controlled with a digital signal via a D/A converter 56 and a separate amplifier 57.

As mentioned above, the loudspeaker unit may also have a display unit 62 for presenting textual and/or graphic information. The display unit may also replace the loudspeaker if there is no need to transmit audio information. A system of this kind could be e.g. one whose display units are placed on the shelves of the shop to indicate prices of the products when a customer is approaching. The display unit can be e.g. such a liquid crystal display module that may be connected directly to the signal processor unit 55. (Modules of this kind are manufactured e.g. by Hitachi, Japan)

In addition to the above described devices, the loudspeaker unit further comprises means with which the loudspeaker unit measures or monitors conditions prevailing in its environment (unit 42, FIG. 4). Different embodiments of these devices will be described in the following.

The sound pressure level detector PL possibly included in the loudspeaker unit may be e.g. a conventional simple microphone if required. The analog signal obtained from the sound pressure level detector is converted into digital form in the A/D converter 51. The information on the sound pressure level obtained from it is applied to the signal processor unit 55, which adjusts the amplification of the amplifier 56 on the basis of the measurement data it has obtained. A/D converters required are manufactured e.g. by Crystal Semiconductor, U.S.A. or Maxim, U.S.A.

The loudspeaker unit may also comprise a radar DR operating on the Doppler principle. Radar devices of this kind are used e.g. for opening doors automatically, and they are manufactured by a number of commercial product suppliers. These radars, which typically operate within the frequency range 10 GHz–20 GHz, indicate the frequency difference between the received signal and the transmitted signal as a voltage at the output terminals of the radar. A frequency difference is generated between the transmitted radio signal and the received radio signal in a case where a radio signal is reflected from a moving target. These radars thus detect people's movements within the target area and indicate the speed of movement as a voltage in the terminals of the device. By monitoring this voltage, it is possible to detect people stopping in the target area. A radar based on the ultrasound principle can also be used for detecting people moving and stopping in the target area. In this case, detection is based on measuring the propagation time of ultrasound, which is used for determining the distance to the target from which the signal has reflected. If a person enters the target area, the propagation time of ultrasound will change, and this will be detected.

The signal provided by the radar devices is converted into digital form by means of the A/D converter 51, and on the basis of this signal, conclusions are drawn regarding the behaviour of the people in the target area. This information is directed via the network to the central processing unit (sound source) CPU, where it is possible to shape or change the audio information passing to the target area. Each loudspeaker unit in the network e.g. in a shopping centre may monitor a separate sales location, and upon a customer entering said location the signal processor is informed of it, and as a result it will send the central processing unit a package like the one shown in FIG. 1, the data field of the package containing information on said event and the address field containing the number of the loudspeaker unit that has sent the package. In response to such a message, the central processing unit (control unit PC) retrieves from its memory MM the files (one or more) corresponding to the address and event codes it has received, and sends them to the loudspeaker unit in question, in which they are forwarded via a D/A conversion to the loudspeaker. There may be e.g. a table stored in the memory of the control unit PC, containing the names of the files corresponding to the address of the transmitting party and the event code (e.g. a code corresponding to the approach of a customer).

A loudspeaker unit LU may also be mobile, in which case it can be provided with positioning means, which are used for determining the current location of the loudspeaker unit within the area covered by the system. This kind of loudspeaker unit can be placed e.g. in a shopping cart, in which case the positioning means situated in the loudspeaker unit transmit the location of the shopping cart to the central processing unit of the system, which can provide the shopping cart with various types of information on the basis of the location of the cart, it can e.g. instruct the customer to move to a desired location within the sales premises or inform the customer of the nearby special offers. Any prior art technique, e.g. triangulation based on the propagation delay of a radio signal, can be used for positioning. One alternative is to equip a loudspeaker unit with a GPS or a DGPS receiver 58, which can be connected directly to the signal processor unit 58. This kind of receiver may be e.g. of the type NavCore V, manufactured by Rockwell Corporation, U.S.A.

Since the GPS or DGPS receivers mentioned above may still be rather costly in the next few years, they can be replaced by employing proximity detectors 59 in fixed loudspeaker units, and, in turn, (passive) identifier tags 60 in the shopping carts. When the shopping cart comes near a proximity detector, the identifier tag will communicate its own identifier to the loudspeaker unit, which will forward the information to the central processing unit of the system. Thus, the information on the movements of an individual person is obtained in the space covered by the system, whereby said person can be transmitted location-specific information via the loudspeaker unit from the central processing unit. This information can be retrieved e.g. by means of the table stored in the memory of the control unit PC. The table contains the names of the files corresponding to the location areas defined in advance.

The proximity detector 59 typically comprises a transceiver 59*a* and a loop antenna 59*b*. A typical identifier tag 60, in turn, comprises a small electronics unit 60*a* and a loop antenna 60*b*. The proximity detector and the identity tag are known per se, and they are thus not paid closer attention to herein. Commercially available proximity detector/identifier tag combinations are manufactured e.g. by Dialog, Holland.

The advantage of loudspeaker units using proximity detectors over loudspeaker units using radars is the fact that it is found out by means of the proximity detector who has entered the vicinity of the loudspeaker unit. When using the system employing proximity detectors, the location of the shopping cart is not known at every moment, however, which is in turn the advantage provided by the positioning means described above.

A mobile loudspeaker unit can also be provided with a card reader 61, which can be connected directly to the signal processor unit 55. The customer thus has at his disposal a personal customer card, or the like, which may be e.g. a smart card. The loudspeaker unit can be placed e.g. in a shopping cart, whereafter the system can monitor the movements of the customers customer-specifically in the space covered by the system. The smart card can e.g. be in possession of regular customers only, in which case they can be informed in some parts of the sales premises of special offers intended for regular customers, for instance. It is possible to collect exact profiles to the central processing unit or an external information system on the behaviour of customers possessing a smart card if desired. By means of these profiles, in turn, the customer may be given highly individualized information via a loudspeaker unit. The customer can e.g. be reminded that he has not yet purchased the product he usually purchases. This information is obtained from the positioning means when the customer passes that part of the sales premises in which the product in question is sold. The same smart card can be used for paying the purchases. Commercially available card readers are manufactured e.g. by Schlumberg, U.S.A.

As to one loudspeaker unit, it can be summarized that a mobile loudspeaker unit typically comprises a loudspeaker (and possibly also a display), positioning means by means of which it is possible to determine the location of the loudspeaker unit at every moment, and possibly a card reader if people are wished to be identified. A fixed loudspeaker unit, in turn, typically comprises a loudspeaker (and possibly also a display), and such monitoring means that may be used for detecting a person in proximity (such as a radar or a proximity detector).

Via the interface unit IU (FIG. 3) placed in the central processing unit, the information collected by the system can be transferred to some other information system. It is possible to obtain information e.g. to a teller terminal system on how frequently a customer stops to look at a certain product. When this information is compared e.g. with the figures indicating the sales volumes of the product in question, information is obtained on the fact how large a percentage of the customers decide on purchasing the product.

The system of the invention can also obtain information from some other information system, e.g. information on prices from the general information system of the shop. Said information is displayed by the system via the display unit of the loudspeaker unit.

The radio receiver RR (FIG. 3) possibly situated in the central processing unit can be used for distributing audio information, in which case it is possible to send the central processing units of several different sound reproduction system the audio information required by them in a centralized manner from one location (which is marked with reference number 30 in FIG. 3), as well as to update previously stored information (e.g. music and advertisements). The central processing unit may also transmit the information on the determination carried out by the loudspeaker unit to the radio system, which consequently supplies the required audio information to the central processing unit, which may either store the information or forward it directly to the loudspeaker unit. The central processing unit may also switch the information transmitted by the radio system directly to the loudspeaker unit in real-time provided that the determination carried out by the loudspeaker unit proves it necessary.

The loudspeaker units of the system can also communicate with each other; an individual loudspeaker unit can e.g. relay the information it has received from the central processing unit further to one or more loudspeaker units. The loudspeaker units can be arranged in groups so that one loudspeaker unit carries out determinations and communicates with the central processing unit on behalf of the entire group, whereby it also forwards the information it has received from the central processing unit to the other loudspeaker units of the group.

The radio receiver is advantageously a receiver in accordance with a known RDS system (Radio Data System), whereby audio information can be transmitted via a broadcasting network. As mentioned above, the operation of the central processing unit can also be controlled via the radio receiver. The control information can be transmitted in an informal switching element, on the use of which the operator of the radio network may freely choose. (the local radio may e.g. send a certain code every time that it is raining outside, whereby the central processing unit of the sound reproduction system will choose an appropriate announcement and/or music).

Although the invention has been disclosed with reference to the examples in accordance with the attached figures, it is obvious that the invention is not limited thereto, but it may be modified within the scope of the inventive idea set forth above and in the attached claims. In principle it is possible e.g. to store the information required by each loudspeaker unit in association with the loudspeaker unit, although it is not as good an alternative as the system implemented by means of a centralized server. The protocol used in the network may also vary in many ways; instead of packages of a variable length, e.g. packages or frames having a fixed length can also be transmitted one multiframe at a time, whereby at the beginning of each multiframe, the number of the data packages contained by it is given. The solution in accordance with the invention can also be used in systems which are exclusively public address systems or in addressed voice mail systems.

What is claimed is:

1. A sound reproduction system for a large space, comprising:

a plurality of loudspeaker units in different locations in said space;

an information source common to said loudspeaker units operable to supply the loudspeaker units with information to be transmitted by said loudspeaker units;

a monitoring device in at least one of said loudspeaker units operable to monitor for the presence of at least one person;

a sending device operable to send from the at least one loudspeaker unit to the information source a message containing information regarding a result of said monitoring;

wherein said information source is operable to send, in response to said message, a reply message to the loudspeaker unit containing information to be transmitted by said loudspeaker unit, wherein said information to be transmitted is dependent on said results of said monitoring; and wherein said at least one of said loudspeaker units is operable to determine an identity of at least one person in a vicinity of said loudspeaker unit.

2. The system of claim 1, wherein said monitoring device is operable to detect movement of said at least one person.

3. The system of claim 1, wherein said monitoring device is operable to determine if said at least one person stops moving.

4. The system of claim 1, wherein said at least one of said loudspeaker units includes a card reader for use in identifying said person.

5. The system of claim 1, wherein said at least one of said loudspeaker units includes a proximity detector for detecting said at least one person.

6. The system of claim 1, further including a broadcast network for transmitting to the information source said information to be transmitted by the loudspeaker unit.

7. The system of claim 1, wherein said at least one loudspeaker unit is operable to relay information received by the loudspeaker unit from the information source to a second one of said loudspeaker units.

8. A method for providing an information system in a large space, comprising:

placing a plurality of loudspeaker units in different locations in said space;

feeding information to be transmitted by said loudspeaker units from an information source common to said loudspeaker units;

monitoring at at least one of said loudspeaker units for the presence of at least one person;

sending from the at least one loudspeaker unit to the information source a message containing information regarding a result of said monitoring;

sending from the information source, in response to said message, a reply message to the loudspeaker unit containing information to be transmitted by said loudspeaker unit, wherein said information to be transmitted is dependent on said results of said monitoring; and said at least one of said loudspeaker units determining an identity of at least one person in a vicinity of said loudspeaker unit.

9. The method of claim 8, wherein said monitoring for the presence of at least one person further includes monitoring for movement of said at least one person.

10. The method of claim 9, wherein said monitoring for movement of said at least one person includes determining if said at least one person stops moving.

11. The method of claim 8, wherein said determining an identity step is performed using of a card reader in the loudspeaker unit.

12. The method of claim 8, wherein said determining an identity step includes using a proximity detector in the loudspeaker unit and an identifier tag provided on said at least one person.

13. The method of claim 8, further including transmitting to the information source said information to be transmitted by the loudspeaker unit by radio via a broadcast network.

14. The method of claim 8, further including relaying information received by the loudspeaker unit from the information source to a second one of said loudspeaker units.

15. A method for providing an information system in a large space, comprising:

placing a plurality of loudspeaker units in different locations in said space;

feeding information to be transmitted by said loudspeaker units from an information source common to said loudspeaker units;

monitoring at at least one of said loudspeaker units for the presence of at least one person;

sending from the at least one loudspeaker unit to the information source a message containing information regarding a result of said monitoring;

sending from the information source, in response to said message, a reply message to the loudspeaker unit containing information to be transmitted by said loudspeaker unit, wherein said information to be transmitted is dependent on said results of said monitoring; and wherein said at least one of said loudspeaker units determines a characteristic of at least one person in a vicinity of said loudspeaker.

16. A method for providing an information system in a large space, comprising:

placing a plurality of loudspeaker units in different locations in said space;

feeding information to be transmitted by said loudspeaker units from an information source common to said loudspeaker units;

carrying out in at least one of said loudspeaker units determinations specific to said loudspeaker unit;

sending from the at least one loudspeaker unit to the information source a message containing information based on said determinations;

sending from the information source, in response to said message, a reply message to the loudspeaker unit containing information to be transmitted by said loudspeaker unit, wherein said information to be transmitted is dependent on the information contained in the message from the loudspeaker unit; and wherein said at least one loudspeaker unit is mobile and said determinations carried out therewith relate to the location of the loudspeaker unit within said large space.

17. A sound reproduction system for a large space, comprising:

a plurality of loudspeaker units in different locations in said space;

an information source common to said loudspeaker units operable to supply the loudspeaker units with information to be transmitted by said loudspeaker units;

a monitoring device in at least one of said loudspeaker units operable to monitor for the presence of at least one person;

a sending device operable to send from the at least one loudspeaker unit to the information source a message containing information regarding a result of said monitoring;

wherein said information source is operable to send, in response to said message, a reply message to the loudspeaker unit containing information to be transmitted by said loudspeaker unit, wherein said information to be transmitted is dependent on said results of said monitoring; and wherein said at least one of said loudspeaker units is operable to determine a characteristic of at least one person in a vicinity of said loudspeaker unit.

18. A sound reproduction system for a large space, comprising:

a plurality of loudspeaker units in different locations in said space;

an information source common to said loudspeaker units for supplying information to be transmitted by said loudspeaker units;

a monitoring device in at least one of said loudspeaker units for making determinations specific to said loudspeaker unit; and a sending device in said at least one loudspeaker unit for sending to the information source a message containing information based on said determinations;

wherein said information source is operable, in response to said message, to send a reply message to the at least one loudspeaker unit containing information to be transmitted by said loudspeaker unit, wherein said information to be transmitted is dependent on the information contained in the message from the loudspeaker unit; and wherein said at least one loudspeaker unit is mobile and said determinations carried out therewith relate to the location of the loudspeaker unit within said large space.

19. The system of claim 18, wherein said large space is a sales premises and said at least one of said loudspeaker units is placed in a shopping cart for use in said sales premises.

* * * * *